United States Patent [19]

Vanlerberghe

[11] Patent Number: 4,506,621

[45] Date of Patent: Mar. 26, 1985

[54] TILTABLE RUDDER

[76] Inventor: John P. Vanlerberghe, 11101 Timber Creek Dr., Grand Ledge, Mich. 48837

[21] Appl. No.: 491,526

[22] Filed: May 4, 1983

[51] Int. Cl.[3] ..... B63H 25/38

[52] U.S. Cl. ..... 114/162; 114/165

[58] Field of Search ..... 114/165, 162, 39, 141, 114/132, 138, 163, 130, 131, 281, 282, 128

[56] References Cited

U.S. PATENT DOCUMENTS

| | | | |
|---|---|---|---|
| 2,437,271 | 3/1948 | Rice | 114/128 |
| 2,991,749 | 7/1961 | Patterson | 114/132 |
| 3,077,850 | 2/1963 | Beuby | 114/281 X |
| 3,326,168 | 6/1967 | Swiggart et al. | 114/162 |
| 3,850,127 | 11/1974 | Thorpe | 114/132 X |
| 3,946,693 | 3/1976 | Brown | 114/165 |
| 4,376,416 | 3/1983 | Carver | 114/39 |

*Primary Examiner*—Sherman D. Basinger

*Attorney, Agent, or Firm*—Miller, Morriss & Pappas

[57] ABSTRACT

A tilting rudder for conversion of a sailboat. The rudder pivots upwardly into concealment in a trunk located somewhat forward of the transom in the cockpit of a sailboat. A seal closes the trunk when the rudder is concealed and opens when the rudder is pivoted to the operative steering position. The rudder is journalled in a sleeve and the sleeve is supported in the trunk. The sleeve captures the rudder bar axially while permitting full rotation of the rudder for steerage. Gasketing at the aft upper corner of the trunk prevents any substantial leakage of water into the cockpit of the sailboat.

6 Claims, 6 Drawing Figures

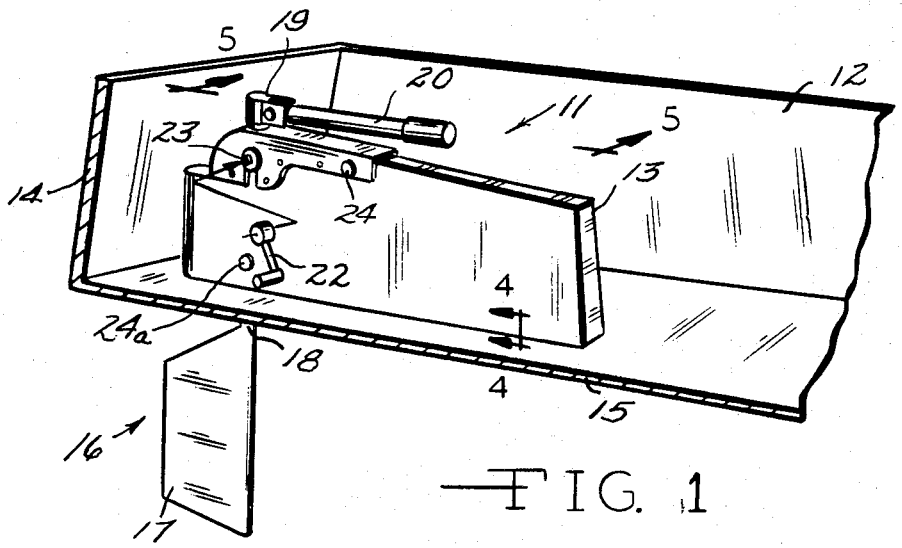
FIG. 1
FIG. 2
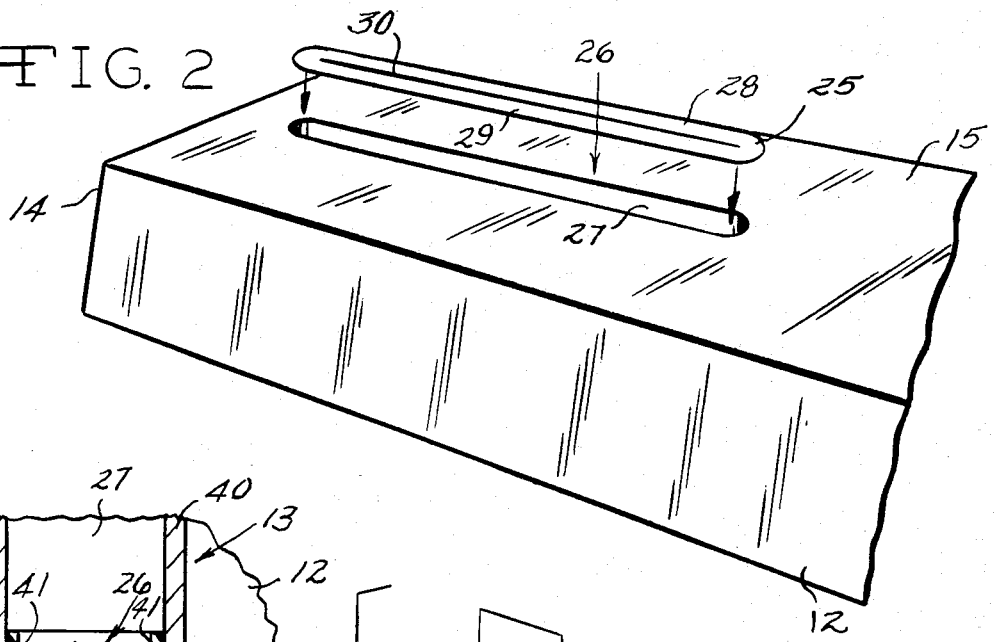
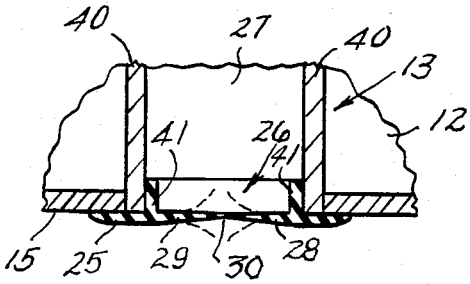
FIG. 4
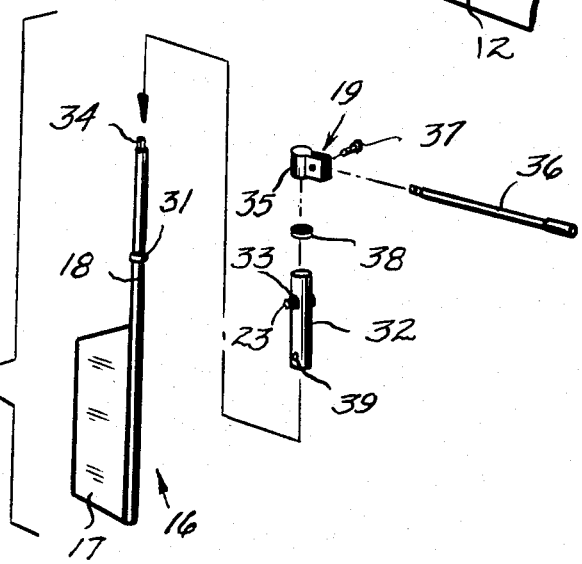
FIG. 3

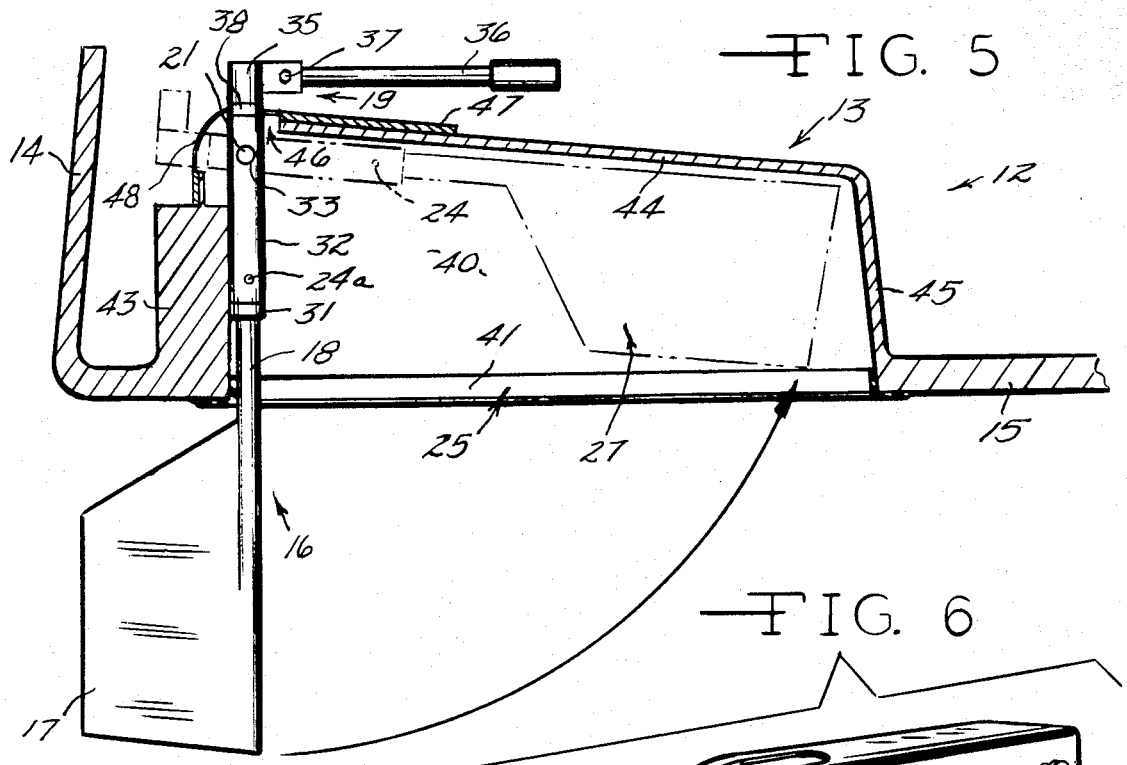
FIG. 5
FIG. 6
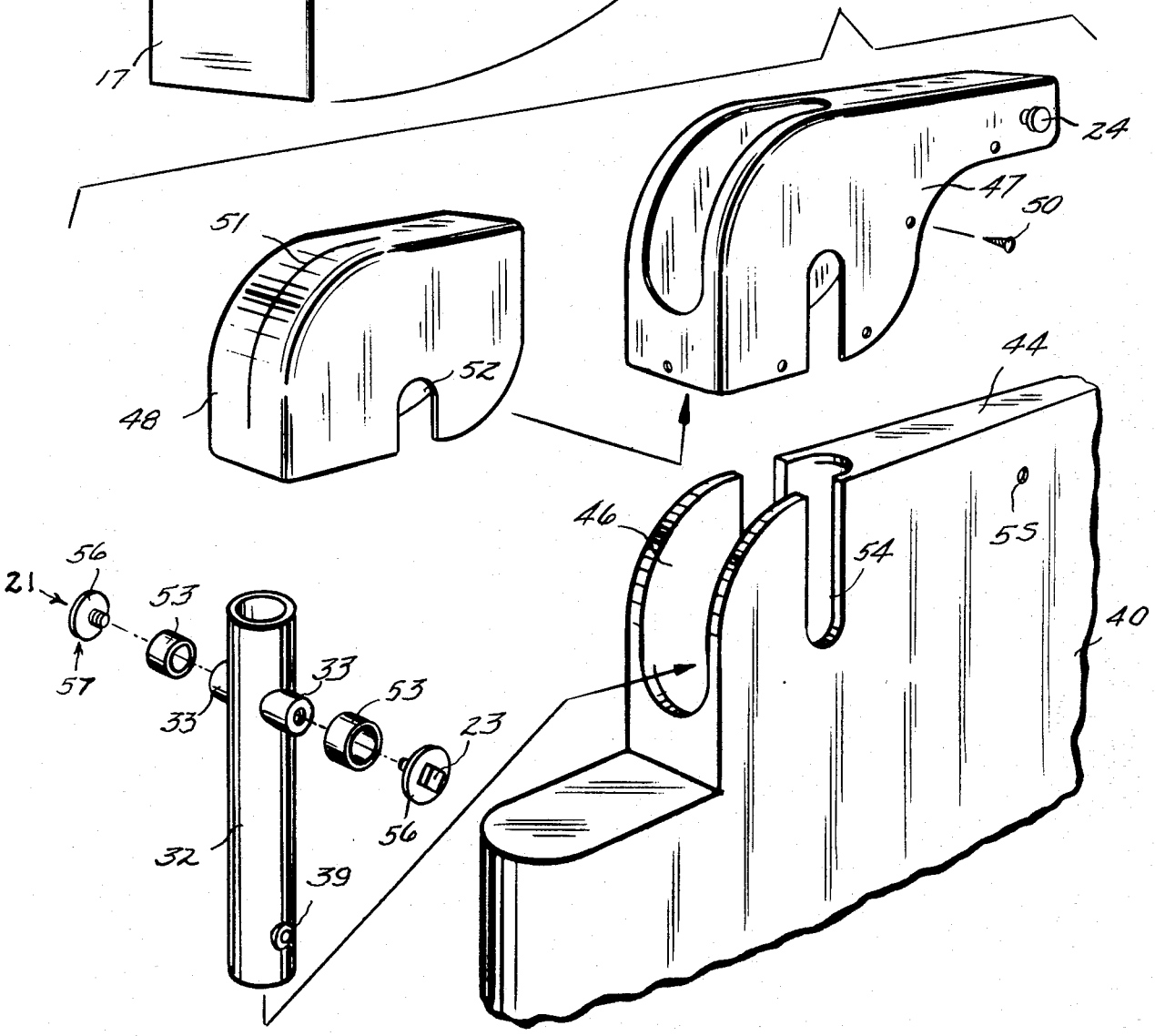

TILTABLE RUDDER

The present invention pertains to sailboats and more particularly to the provision for a selectively tiltable rudder which conceals itself, when not in use, in a rudder trunk defining a cavity located in the cockpit of a sailboat and extending forwardly from a wall adjacent the sailboat transom. The rudder is pivotally supported in the trunk and stop means are provided for securing the rudder in selected of an operative and an inoperative position. In a specific sense, the present invention seeks to allow a sailboat conversion from propulsion by wind to propulsion as by an outboard power source which, itself, is capable of directionally controlling the craft. By retracting the sailing rudder by means of tilting it into a rudder trunk, the rudder is moved out of a directing or operative position thereby eliminating drag and misdirection. In the lifting of the rudder by tilting, seal means closing the opening into the trunk cavity through the bottom of the boat further act in prevention of serious drag which might otherwise impede the motor propulsion.

Trunks in sailboats are well known for the use of centerboards and the like. In some instances trunks or wells have been used for rudders or directional attenuating means. Such instances, as known, deviate substantially from the pivotal simple concepts herein expressed. The prior art is characterized by the U.S. Pat. No. 4,376,416 to George P. Carver and directed principally to a centerboard or keel control mechanism serving in the conversion of a sailboat to a motorboat; by U.S. Pat. No. 3,946,693 to Marshall S. B. Brown for a removable inboard rudder which is dropped into place and retained in operative position by a wedge-shaped filler element; and U.S. Pat. No. 3,326,168 to W. H. Swiggart, III, et al for a retractable barge rudder which contemplates a rudder well and a mechanism in a rudder post which combines vertical extension and retraction of the rudder post and rotation of that post to change the rudder attitude upon being lowered into the water; and by U.S. Pat. No. 2,991,749 to G. W. Patterson for a hydrofoil structure and proposing a resiliently supported rudder having an overcomable bias toward an operating attitude. These devices are not viewed as showing or suggesting the construction proposed herein and the structure herein expressed substantially and unobviously extends the art of conversion boating and storing of a rudder in sailboat construction generally.

Accordingly, the principal object is to teach a storage trunk for sailboat rudders located in the sailboat and slightly forward of the transom and extending in the projected plane of the keel forwardly toward midship of the sailboat.

Another object is to provide a structure useful in smaller sailboats which is manually operable from the cockpit and which does not clutter the transom.

Another object is to provide a rudder having two principal positions in a trunk and stop means for securing the rudder in one of the selected extreme positions.

Another object is to achieve the other objectives while trimming the bottom of the sailboat in reduction of drag at the trunk entry.

Still another object is to provide gasketing means at the top of the trunk in prevention of the seas slopping their way into the cockpit via the trunk.

Still other objects, including simplicity, economy, and relatively simple conversion of existing sailboats will be appreciated more fully as the description proceeds.

GENERAL DESCRIPTION

In general, the present invention is directed to a tiltable rudder structure for sailboats and especially for the conversion of sailing craft to motor craft as by use of an outboard engine which usually includes self-contained rudder means. The principal elements of the structure are a rudder trunk located inboard of the transom and extending longitudinally of the keel of a sailing boat, a rudder which includes a rudder post and attached blade. The rudder is pivotally supported by the trunk so as to pivot from a lower operable steering position to an elevated and concealed inoperative position in the trunk. A detachable tiller is attached to the top of the rudder post and by this means in the lowered operable position the rudder is manipulated to steer the craft. Stop means are included which selectively secure the rudder in the operative and inoperative positions.

Additionally, the trunk is closed upon pivoting the rudder into the concealed position thereby avoiding drag on the craft when the rudder is in the inoperative position. The pivotal support means for the rudder in the trunk and the rudder post is gasketed in respect to the trunk in prevention of leakage of water through the top of the trunk.

Details of this construction and the preferred embodiment thereof will be increasingly appreciated as the description proceeds and the drawings are understood.

IN THE DRAWINGS

FIG. 1 is a cutaway perspective view of an aft inboard portion of a boat equipped with the tiltable rudder of the present invention.

FIG. 2 is a cutaway perspective view of an aft-portion of the boat of FIG. 1 and with the boat inverted to indicate the opening for the trunk through which the rudder seen in the FIG. 1 depends and indicating the resilient annular seal as installed in the opening to close the opening on anything extending through the opening.

FIG. 3 is an exploded perspective view of the rudder assembly of blade, post, tubular sleeve and with trunnion means and detent stop provisions and with tiller and tiller connector means.

FIG. 4 is a partial section view taken on the line 4—4 of FIG. 1 and indicating the installed position of the annular resilient seal and the lapping lips thereof closing the trunk opening through the bottom of the craft.

FIG. 5 is a full section elevation view through the trunk on the line 5—5 of FIG. 1 and indicating the rudder in the operating steering condition and in phantom line indicating the retraction or concealment inoperative position of the rudder in the trunk.

FIG. 6 is an exploded perspective view of the aft upper corner of the trunk to provide bearing support and gasketing for the rudder and indicating the means of trunnion support of the pivoting sleeve for the rudder and the lower lock pin receptacle. Also shown is the gasket seal and the hold-down cover through which the rudder post extends. The detent lock for the raised or concealed inoperative position of the rudder is shown as a manually operable lock pin supported in the cover and extending through the trunk to impingement in the lock pin cavity in the tubular rudder sleeve.

SPECIFIC DESCRIPTION

Referring to the drawings and with first specific reference to the FIG. 1 thereof, the tiltable rudder structure 11 of the present invention is seen installed in the sailboat or sailcraft 12. The trunk 13 is seen located adjacent and forwardly of the transom 14 and the trunk 13 lies longitudinally of the craft 12 and surrounding (as will be seen) an opening through the longitudinal centerline of the bottom 15 of the craft 12 in the extended plane of the keel of the craft or vessel 12. The rudder 16 is indicated in its extended position below the bottom and if the vessel 12 were in the water this position is the lowered or steering position. The rudder 16 includes the blade portion 17 attached firmly to the rudder post 18 which, in operation, is positioned generally vertically as shown. The rudder post 18 extends through the trunk 13 and is selectively and operably engaged by the connector 19 and tiller or bar and handle 20. The rudder 16 is tiltable in the trunk 13 on the pivot 21.

As will be appreciated, the opening in the top-aft portion of the trunk 13 is slotted so that as the rudder post 18 is tilted to raise or lower the rudder 16 into or below the trunk there is planar control of the rudder 16 and post 18. A crank 22 is shown which is detachable from an out-of-round extension 23 of the pivot 21 and this provides assistance means to elevation of the rudder 16 into the trunk 13. Two gasketed lock pins 24 and **24*a* are provided through the wall of the trunk 13 and these assist in detent locking the rudder 16 into a concealed storage position, or in an extended steering position as shown in FIG. 1. As will be seen, the pin 24*a* is not essential when the sailing craft 12 is under forward way but in instances of tacking and close beating the pin 24*a* prevents the rudder 16 from any tendency to retreat into the trunk 13. This also prevents dislocation of the rudder 16 if the sailboat is blown rearwardly. In some instances the transom 14 may be used as an aft wall for the trunk 13 but the slightly inboard location from the transom 14 is preferred. As will be appreciated, the precise location will likely be dictated by the style and design of the sailboat 12**.

In the FIG. 2 the resilient annular seal 25 is seen poised over the opening 26 defining the lower extreme of the trunk cavity 27 formed by location of the trunk in the sailboat 12. The opening 26 is through the bottom 15. The seal 25 forms lips 28 and 29 which close upon each other in a slight overlap slit 30, as will be seen, so as to close against the rudder 16 and post 18 in prevention of serious drag as might otherwise be experienced using an open trunk.

In the FIG. 3 the assembly of tiltable rudder 16 is best appreciated. The rudder blade 17 is firmly fixed to the rudder post 18. The style of the rudder blade 17 should be such as to allow concealment of the rudder 16 in the trunk 13 when tilted into the trunk cavity 27 and into the inoperative position. A collar 31 is fixed to the post 18, as shown, and forms a thrust shoulder against which the tubular sleeve 32 forming pivot and axial journal for the rudder 16, rests. The tubular sleeve 32 includes stub shafts or trunnions 33 which extend transversely of the principal and longitudinal axis of the sleeve 31 and forming, as will be seen, the pivot 21, in cooperation with the trunk 13. One of the trunnions 33 includes an integral out-of-round extension 23 allowing the sleeve to be cranked or turned by mechanical or manual means to elevate or lower the rudder 16. At the top of the rudder post 18 is an axially projecting out-of-round extension 34 mating with a socket cavity in the connector 35 whereby the rudder post 18 can be steerably turned in the elongate bearing formed by the tubular sleeve 32. The connector 35 is selectively connected to the tiller 36 as by the pin 37 or other well known attaching means in the art. Thus, the connector 35 operably joins tiller 36 and post 18. The collar stop 38 is fastened on the rudder post 18 and bears on the top of the tubular sleeve 32. While a single piece disc forms the collar 38 and is generally satisfactory, a thrust bearing may be located with the collar 38 in reduction of friction between collar and sleeve 32 and in facilitating steering.

A detenting cavity 39 is provided in the wall of the tubular sleeve 32 and the object of the cavity is to become a part of a detent stop selectively holding the rudder assembly 16 in the raised inoperative position or the lowered operative steering position as shown in FIG. 1. The lock pins 24 and **24*a* are detentably engaged and disengaged in the cavity 39**.

The FIG. 4 indicates the preferred embodiment of the annular seal 25 as fastened in the trunk opening 26 through the bottom 15 of the sailing craft. The vertical spaced-apart walls 40 of the trunk 13 assist to define the trunk cavity 27 in which the rudder 16 is retractable. The longitudinal slit or overlap 30 by the lips 28 and 29 close the bottom of the cavity 27 substantially completely when the rudder assembly 16 is concealed in the trunk 13 and the lips 28 and 29 deflect to permit lowering of the rudder 16 while snuggly fitting round the rudder post 18 at full extension. The flexure or resilience of the lips 28 and 29 is indicated in phantom line. The annular flange 41 provides the means for attachment of the seal 25 in the opening 26 through the bottom of the sailboat 15. The flange 41 is adhered to the walls 40 as shown but rivets, screws, or other fasteners with or without framing or stiffening may be used as known in the art.

Not shown, but well appreciated in the art, is that the walls 40 are secured to the bottom 15 and other structurals of the boat 12 as by caulking or resin or plastic fillers suitably reinforced as with fiberglass or other plastic material.

In the FIG. 5 the rudder assembly 16 is shown in the operative position with the blade 17 depending in the steering posture and with the rudder post 18 normally and firmly engaged against the aft wall 43 of the trunk 13 adjacent the transom 14. Thus the operating thrust of the forward motion of the boat 12 against the blade 17 is absorbed into the buttress of wall 43. The pivot 21 at the sleeve 32 is the pivot axis for the two extreme positions of the rudder 16. The raised position of the rudder 16 is as shown in phantom line and the lock pins 24 and **24*a* are shown detent securing those extremes of position until manually released. The annular seal 25 and the attaching flange 41 is visible and deformation of the lips 28 and 29 can be appreciated as the rudder 16 is raised and lowered through the resilient lips 28 and 29. The material of the seal 25** is rubber-like and formulated to provide good memory characteristics and to resist deterioration under aquatic conditions.

The upper cover strip 44 of the trunk 13 is an extension of the forward cover strip 45 which continuously bridges the space between the walls 40 of the trunk 13. A gap 46 in the upper wall 44 at the aft upper corner of the trunk 13 permits limited arcuate movement of the rudder post 18 and sleeve 32 to the two extreme positions of travel indicated. A cover 47 trims the upper aft edge and the deformable gasket 48 provides a lip-like seal against the tubular sleeve 32 and bar 18 in prevention of any extension water leakage through the trunk 13 and into the sailboat 12. The composite view of FIG. 6 illustrates the construction of the cover 47 carrying lock pin 24. The cover 47 defines the upper parameters of an arcuate opening 49 registrably over the opening 46 in the trunk 13. The fastening means shown are screws 50 which are preferred where disassembly is desirable. The cover 47 provides bearing and operative support for the lock pin 24, as shown, and which pin 24 is detentably oriented in respect to the lock cavity 39 in the sleeve 32. Fitted within the cover 47 is the formed gasket 48 made of resilient material and functioning similar to the annular seal 25 in the trunk 13. The slit 51 in gasket 48 permits the operable protrusion of the tubular sleeve 32, thrust collar 38, and the post 18, which runs in the sleeve 32. The gasket element 48 is relieved, as shown, and the relief 52 snuggly fits round the trunnions 33 of the tubular sleeve 32 or against gasket sleeves 53 which form the bearing bushings which rest against the walls 40 of the trunk 13 in the journals formed by the slots 54 in the trunk 13. The opening 55 through the wall 40 for the stop pin 24 is visible and the registry, with the lock pin opening or cavity 39, can be appreciated. While the gasket 48 is a preferred embodiment, other forms of moving gaskets, as for example, a sliding membrane seal collared around the sleeve 32 and shiftable through the arc of the opening 46 might be satisfactory if economically feasible.

The crank handle head comprising an out-of-round extension 23 from the stub shafts 33 are shown in a non-integral preferred form and are inserted in the end of the stub shaft 33, and locked drivably into place. In this way the handle 22 of FIG. 1 or a winch (not shown) can be applied to the task of orienting the rudder assembly 16 up and down. Flanges 56 on the element 33 and the threaded end fastener 57 provide lateral bearing control at the pivot 21 and adapt the structure to use of O-ring seals at the pivot 21, if desired.

While the structure of the present invention is suited for integral forming of the trunk 13 at the time of sailboat fabrication, it is also intended that the invention embrace a kit assembly concept where templets permit suitable location and inletting in the bottom of the craft and then the trunk 13 is insertable in the opening 26 along with rudder assembly 16 and recited journals, seals and lock pins. The trunk 13 is fiberglassed in place adjacent the transom 14 and on the centerline of the bottom 15 in line with the keel plane.

In operation, when it is desired to convert a sailing vessel to an outboard powered craft, the rudder assembly 16 is simply pivoted into the trunk 13 in an arc toward the bow of the craft and it is fully concealed. Then steering of the craft can proceed from the movement of the outboard engine. The annular trunk seal, as described, closes behind the concealed rudder trimming out the usual drag of an open trunk so that the motor is most effective in driving the converted craft. The dropping of the rudder 16 is easy by removal of detent pin 24 and the pivoting rudder 16 stops against the aft wall of the trunk 13 and detentably is there secured against forward arcuate displacement.

Having thus described my invention and the preferred embodiment thereof, those skilled in the art will readily perceive changes, modifications and improvements within the skill of the art. Such changes, modifications and improvements are intended to be included herein limited only by the scope of my hereinafter appended claims.

I claim:

1. A rudder storage structure for sailboats comprising:

a rudder trunk defining an opening through the bottom of a sailboat and rising in the same plane as the keel of said sailboat along and into the cockpit of said sailboat and adjacent the transom of said sailboat and further defining a rudder concealing cavity including journal means and an upper aft operating slot, said trunk including an aft-most wall and a forward cavity portion;

a tubular sleeve having transverse trunnions extending operably into said journal means in said trunk;

a rudder pivotally supported in said trunk having a rudder post extending axially through said sleeve and supported by said journal means and movable to a first operating position, said sleeve engaging the aft-most wall of said trunk and pivotally movable to a second inoperative position in the forward cavity portion of said trunk; and stop means selectively securing said rudder in selected of said two extremes of position.

2. A tiltable rudder structure for retraction in conversion of sailing craft to accommodate motor propulsion and direction comprising:

a rudder trunk including journal means and an upper aft operating slot for locating adjacent the transom of a sailing craft and through an opening in the bottom of said sailing craft and extending longitudinally of the keel of said sailing craft and rising into the cockpit of said sailing craft, said trunk including an aft-most wall and a forward cavity portion;

a tubular sleeve having transverse trunnions extending operably into said journal means in said trunk;

a rudder comprising a rudder post and attached blade pivotally supported by said sleeve in said trunk and movable in said journal means from a lower operable steering position with said sleeve engaging the aft-most wall of said trunk to an elevated concealed inoperative steering position in said forward cavity portion of said trunk;

a detachable tiller selectively attached to the top of the rudder post whereby selected rotation of the rudder post controls the direction of said craft when said rudder is in the lower operable steering position; and stop means selectively securing said rudder in the operative and inoperative positions.

3. In the structure of claim 2 wherein said tubular sleeve having transverse trunnion extensions axially supports said rudder post and said trunnion extensions are supported by said trunk to allow pivotal movement of said rudder into and from said trunk.

4. In the structure of claim 2 wherein said trunk is closed by elongate resilient lips substantially at the opening of said trunk through said bottom of said sailing craft.

5. A rudder storage structure for sailboats comprising:

a rudder trunk positioned registrably above an opening through the bottom of a sailboat and extending from adjacent the transom of said sailboat forwardly in the plane of the keel of said sailboat, said trunk defining a longitudinal cavity above said opening and said trunk having journal means therethrough and an upper aft operating slot;

a tubular sleeve having transverse trunnions extending operably into said journal means in said trunk;

a rudder having a rudder post, said rudder post extending through said sleeve and operably connected thereto for rotational movement on the axis of said post and said rudder post being pivotal with said sleeve on said trunnions selectively raising said rudder into said cavity of said trunk and lowering said rudder into operative extension;

a detachable tiller operably connected to and detachable from said rudder post;

a gasket seal closing around said rudder post and said sleeve and substantially closing said trunk at the top thereof;

an annular seal around said opening through said bottom of said sailboat, said seal having resilient lips closing said trunk cavity around said rudder post at the bottom of said sailboat in the lowermost positioning of said rudder and closing said trunk upon the uppermost positioning of said rudder in said trunk; and stop pins securing said rudder in the two extremes of the pivotal movement of said rudder.

6. In the combination of claim 5 in which said stop pins lockably and unlockably mate with cooperating recess means on said tubular sleeve.

* * * * *